US011122895B2

(12) United States Patent
Kampl

(10) Patent No.: US 11,122,895 B2
(45) Date of Patent: Sep. 21, 2021

(54) RAILING STRUT FOR A DRAWER

(71) Applicant: Julius Blum GmbH, Hoechst (AT)

(72) Inventor: Markus Kampl, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/893,793

(22) Filed: Jun. 5, 2020

(65) Prior Publication Data

US 2020/0297111 A1 Sep. 24, 2020

Related U.S. Application Data

(63) Continuation of application No. PCT/AT2018/060298, filed on Dec. 13, 2018.

(30) Foreign Application Priority Data

Dec. 21, 2017 (AT) ..... A 51061/2017

(51) Int. Cl.
*A47B 88/95* (2017.01)
*A47B 88/938* (2017.01)

(52) U.S. Cl.
CPC ..... *A47B 88/938* (2017.01); *A47B 88/95* (2017.01); *A47B 2088/939* (2017.01); *A47B 2088/94* (2017.01); *A47B 2088/954* (2017.01)

(58) Field of Classification Search
CPC ..... E05C 17/52; E05C 19/06; E05C 19/063; E05C 19/066; Y10T 292/0814;
(Continued)

(56) References Cited

U.S. PATENT DOCUMENTS 4,974,987 A * 12/1990 Smock ..... E04B 2/744 403/252
5,207,526 A 5/1993 Brüstle et al.
(Continued)

FOREIGN PATENT DOCUMENTS

CN 2627916 7/2004
CN 202234007 5/2012
(Continued)

OTHER PUBLICATIONS

English translation for DE202011106766 (Year: 2013).*
(Continued)

*Primary Examiner* — Janet M Wilkens
(74) *Attorney, Agent, or Firm* — Wenderoth, Lind & Ponack, L.L.P.

(57) ABSTRACT

A railing strut includes an end region to be connected to a wall element of the drawer. The railing strut, on the end region, includes a locking device having a locking element to be engaged with the wall element for locking the railing strut. The railing strut further includes a movably mounted actuating element, and the locking element can be moved by applying a force to the actuating element into a release position in which the locking between the railing strut and the wall element can be released when the railing strut is in a locked condition with the wall element. The actuating element, when the railing strut is locked to the wall element, is accessible for manual actuation and can be directly actuated, so that the locking between the railing strut and the wall element can be released by manual actuation of the actuating element.

20 Claims, 4 Drawing Sheets

(58) Field of Classification Search

CPC ..... Y10T 292/0817; Y10T 292/082; Y10T 292/0876; Y10T 292/088; Y10T 292/0894; Y10T 292/0898; Y10T 292/0901; Y10T 292/0907; Y10T 292/42; Y10T 292/438; Y10S 292/38; A47B 2096/203; A47B 2220/0086; A47B 88/931; A47B 88/427; A47B 88/95; A47B 88/938; A47B 2208/954; A47B 2208/939; A47B 2088/94; A47B 88/956; A47B 88/939; A47B 88/941

USPC ..... 312/348.1, 348.2, 330.1, 334.7, 334.8, 312/348.4, 319.1

See application file for complete search history.

(56) References Cited

U.S. PATENT DOCUMENTS

| | | | | | |
|---|---|---|---|---|---|
| 5,284,399 | A | | 2/1994 | Brüstle et al. | |
| 5,312,201 | A | | 5/1994 | Brüstle et al. | |
| 5,466,061 | A | * | 11/1995 | Lautenschlager | A47B 88/931 312/348.2 |
| 5,690,405 | A | | 11/1997 | Huber | |
| 6,120,226 | A | * | 9/2000 | Egger | A47B 88/90 411/48 |
| 6,402,420 | B1 | * | 6/2002 | Yang | F16B 7/0473 403/381 |
| 7,165,790 | B2 | * | 1/2007 | Bella | E05C 19/022 292/302 |
| 8,220,885 | B2 | * | 7/2012 | Weber | F16B 12/26 312/348.4 |
| 9,060,605 | B2 | * | 6/2015 | Gasser | A47B 88/941 |
| 9,161,624 | B2 | * | 10/2015 | Haemmerle | A47B 88/931 |
| 10,327,550 | B2 | * | 6/2019 | Held | A47B 88/941 |
| 10,932,569 | B2 | * | 3/2021 | Held | A47B 88/956 |
| 2007/0159039 | A1 | | 7/2007 | Lam et al. | |
| 2011/0163647 | A1 | * | 7/2011 | Hartl | A47B 88/931 312/334.7 |
| 2013/0257251 | A1 | * | 10/2013 | Gasser | A47B 88/941 312/348.2 |
| 2013/0293079 | A1 | * | 11/2013 | Haemmerle | A47B 88/40 312/334.8 |
| 2014/0117828 | A1 | * | 5/2014 | Gasser | A47B 88/427 312/333 |
| 2014/0197724 | A1 | * | 7/2014 | Gasser | A47B 88/941 312/330.1 |
| 2018/0177297 | A1 | | 6/2018 | Held | |

FOREIGN PATENT DOCUMENTS

| | | | |
|---|---|---|---|
| CN | 203692952 | | 7/2014 |
| DE | 3024972 | * | 1/1982 |
| DE | 4330919 | * | 3/1995 |
| DE | 10 2009 025 792 | | 11/2010 |
| DE | 202011106766 | * | 3/2013 |
| DE | 102016116178 | * | 3/2018 |
| EP | 0 456 091 | | 11/1991 |
| EP | 698357 | * | 2/1996 |
| EP | 0 723 752 | | 7/1996 |
| EP | 2742826 | * | 6/2014 |
| EP | 2 323 518 | | 4/2017 |
| JP | 2012-502697 | | 2/2012 |
| WO | 03023275 | * | 3/2003 |
| WO | 2012092631 | * | 7/2012 |
| WO | 2013185154 | * | 12/2013 |
| WO | 2017/001610 | | 1/2017 |
| WO | 2019148222 | * | 8/2019 |

OTHER PUBLICATIONS

International Search Report dated Jan. 31, 2019 in International (PCT) Application No. PCT/AT2018/060298.

English translation of Search Report dated Jun. 2, 2021 in Chinese Application No. 201880082186.6.

* cited by examiner

RAILING STRUT FOR A DRAWER

BACKGROUND OF THE INVENTION

The present invention relates to a railing strut for a drawer, the railing strut having at least one end region configured to be connected to a wall element of the drawer. The railing strut, on the at least one end region, includes a locking device having at least one locking element configured to be engaged with the wall element for locking the railing strut. The railing strut includes, in addition to the at least one locking element, at least one movably mounted actuating element, and the at least one locking element, by applying a force to the actuating element, can be moved into a release position in which the locking between the railing strut and the wall element can be released when the railing strut is in a locked condition with the wall element.

Furthermore, the invention concerns an arrangement comprising at least one railing strut of the type to be described, and at least one wall element, in particular a front panel or a rear wall, of a drawer, and the end region of the railing strut can be releasably connected to the wall element by the locking device.

Further, the invention relates to a drawer comprising at least one railing strut of the type to be described, and a method for mounting and demounting a railing strut on a drawer.

Railing struts are used in order to enlarge the receiving volume of a drawer, for reinforcing the drawer, and, in the case of a length-adjustable configuration, also for adjusting an inclination of a drawer front panel. Usually, the railing struts are positioned a predetermined distance above the drawer sidewalls, and the longitudinal direction of the railing strut extends substantially parallel to the longitudinal direction of the drawer sidewall.

An example of a railing strut is shown in EP 2 323 518 B1 to the present applicant. The rear end portion of the railing strut is thereby configured to be connected to the rear wall of the drawer by a snap-connecting element. The snap-connecting element can include one or a plurality of plastic tabs which, in a locked condition of the railing strut, engage in corresponding openings of the rear wall. A drawback is the fact that demounting of the railing strut from the rear wall is relatively elaborate and can only be performed with a large manual effort.

US 2007/159039 A1 discloses a drawer having a railing strut which, in a rear end region, is provided with a clip for releasably connecting to a drawer rear wall. The clip includes a resilient limb with a tab arranged thereon, and the tab engages into a corresponding receiving opening of the rear wall when the railing strut is mounted. For releasing the locking, a screwdriver is to be inserted into an access opening of the rear wall, so that the locking between the tab and the receiving opening of the drawer rear wall can be released. By lifting the resilient limb with the aid of the screwdriver, the tab can be moved out, against its resilient action, from the receiving opening of the rear wall, whereby the railing strut can be separated from the drawer rear wall. A drawback is the fact the view to the tab is restricted and the accessibility to the tab is hindered, and a tool is also indispensably required for releasing the locking.

Further releasable fastening possibilities of a railing strut to a drawer are disclosed in CN 2627916 Y, WO 2017/001610 A1, DE 10 2009 025 792 A1 and EP 0 723 752 A2.

SUMMARY OF THE INVENTION

It is therefore an object to the present invention to propose a railing strut of the type mentioned in the introductory part, thereby avoiding the above-discussed drawbacks.

According to the invention, at least one actuating element, in a condition in which the railing strut is locked to the wall element, is accessible for manual actuation for an operator and can be directly actuated, so that the locking between the railing strut and the wall element can be released by the manual actuation of the actuating element.

In other words, the railing strut includes at least one movably mounted actuating element for releasing the locking between the railing strut and the wall element of the drawer when the railing strut is in a mounted condition on the wall element. The actuating element of the railing strut, in the mounted position thereof, is accessible for an operator and can be directly actuated, so that a comfortable demounting of the railing strut (for example for cleaning purposes) can be enabled.

The actuating element can be configured so as to be separate from the at least one locking element. Alternatively, it is possible that the actuating element and the at least one locking element are arranged on a common member, but are configured as components that can be clearly distinguished from one another. According to an embodiment, the actuating element and the locking element are movement-coupled to one another, so that an appropriate application of force to the actuating element leads to a (destruction-free) movement of the locking element into the release position.

The actuating element can be displaceably arranged on the railing strut, preferably in a longitudinal direction of the railing strut, and/or can be arranged so as to be pivotable or bendable about an axis, preferably about an axis extending in a horizontal direction in the mounted position.

The actuating element can be movably arranged on a front face of the railing strut and/or on a shell surface of the railing strut. For example, the actuating element can be arranged so as to be substantially flush with the front face of the railing strut and/or substantially flat with a shell surface of the railing strut, so that an inadvertent application of force to the actuating element can be prevented and an attractive visual appearance can be provided.

The actuating element is configured to be manually actuated, and the actuating element may be provided with an anti-slip serration in order for the static friction to be increased.

The at least one end region of the railing strut can include at least two locking elements, and the at least two locking elements can jointly be moved into the release position by applying a force to the actuating element. Due to the arrangement of two or more locking elements configured to be jointly moved into a release position in which the wall element can be released, a very tilting-proof connection between the railing strut and the wall element and a comfortable unlocking of the locking elements from the wall element of the drawer can be provided.

The railing strut can be directly connected to a wall element of the drawer, for example by a pin arranged on the railing strut, and the pin is configured to be introduced into a bore of the wall element so as to be held in position. Alternatively, it is possible that the railing strut is connected to the wall element by at least one furniture fitting arranged or formed on the wall element.

BRIEF DESCRIPTION OF THE DRAWINGS

Further details and advantages of the invention result from the following description of figures, in which.

DETAILED DESCRIPTION OF THE INVENTION

Figure 1:
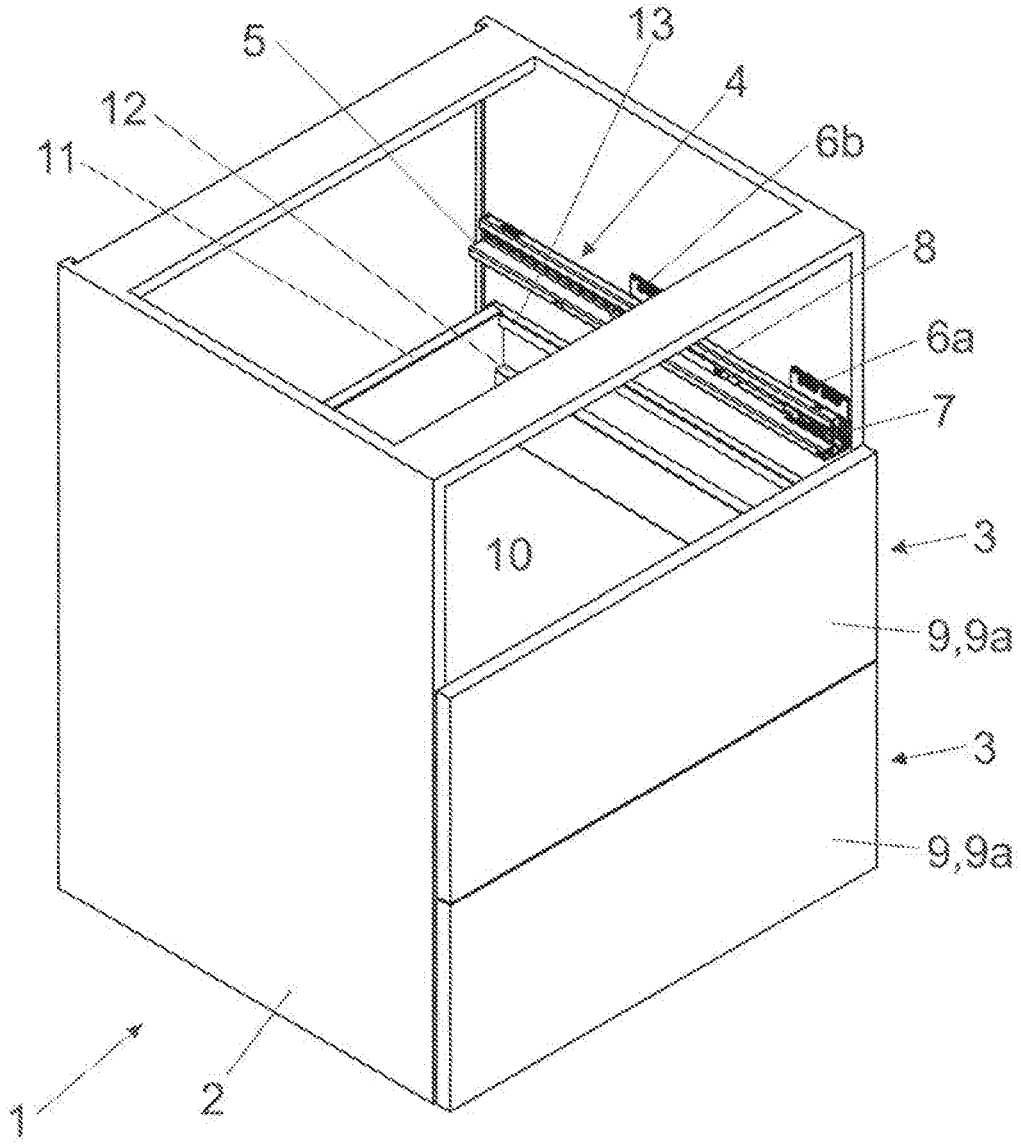
FIG. 1 is a perspective view of an item of furniture with drawers displaceably supported relative to a furniture carcass by drawer pull-out guides.

FIG. 1 shows a perspective view of an item of furniture 1 having a furniture carcass 2 and drawers 3, and the drawers 3 are displaceably supported relative to the furniture carcass 2 by drawer pull-out guides 4. The drawer pull-out guides 4 include a carcass rail 5 to be fixed to the furniture carcass 2 by fastening portions 6*a*, 6*b*, and at least one drawer rail 8 to be connected to the drawer 3, the drawer rail 8 being displaceably supported relative to the carcass rail 5. In order to enable a full extension of the drawer 3, an additional central rail 7 can be provided, the central rail 7 being displaceably arranged between the carcass rail 5 and the drawer rail 8. Each of the drawers 3 includes wall elements 9, 11 (preferably in the form of a front panel 9*a* and a rear wall 11*a*), a drawer bottom 10 and a drawer sidewall 12, the drawer sidewall 12 being connected or being configured to be releasably connected to the drawer rail 8 of the drawer pull-out guide 4. Moreover, at least one railing strut 13 is provided, the railing strut 13 extending over at least a partial region between the front panel 9*a* and the rear wall 11*a* and being arranged with a predetermined distance above the drawer sidewall 12. The longitudinal direction (L) of the railing strut 13 extends substantially parallel to the drawer sidewall 12 in a mounted condition. At least one second decorative plate 14*b* (see FIG. 2*b*) may be arranged between the drawer sidewall 12 and the railing strut 13.

Figure 2A:
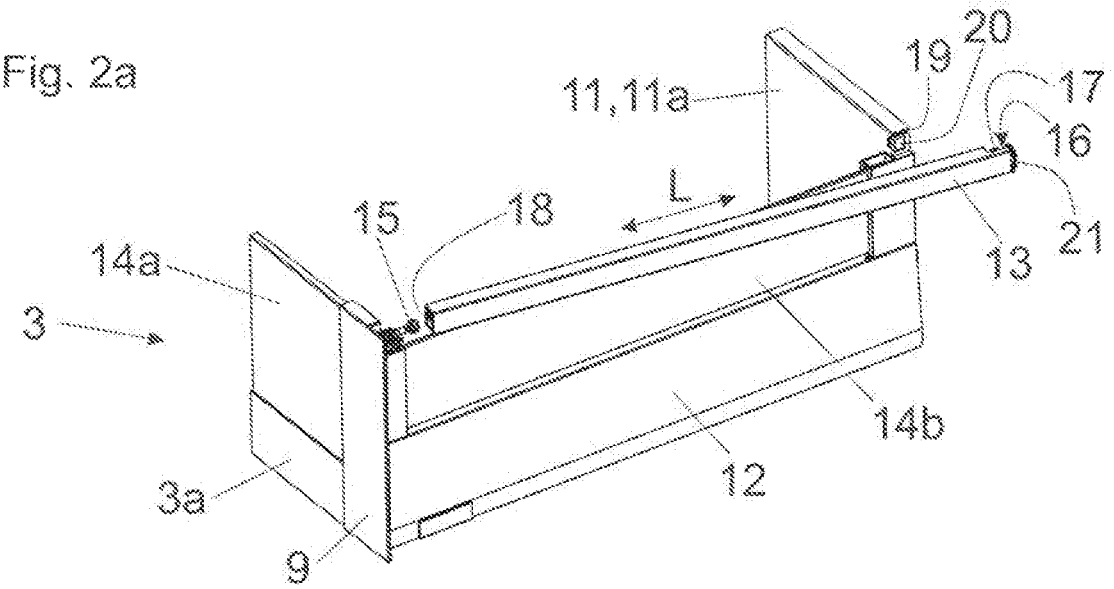
FIG. 2*a*-2*c* show the mounting operation of the railing strut in temporally subsequent steps.
Figure 2B:
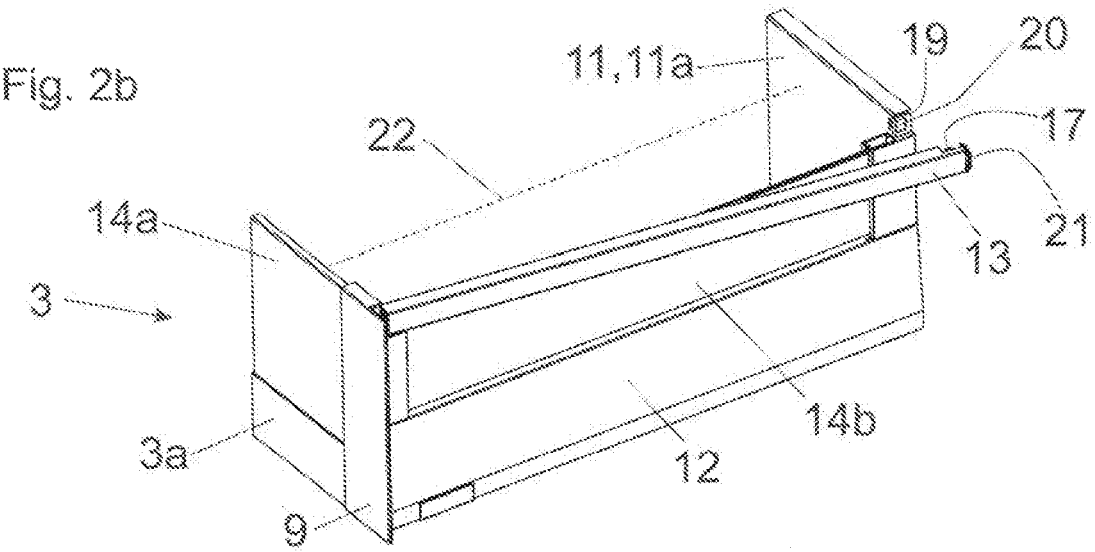
Figure 2C:
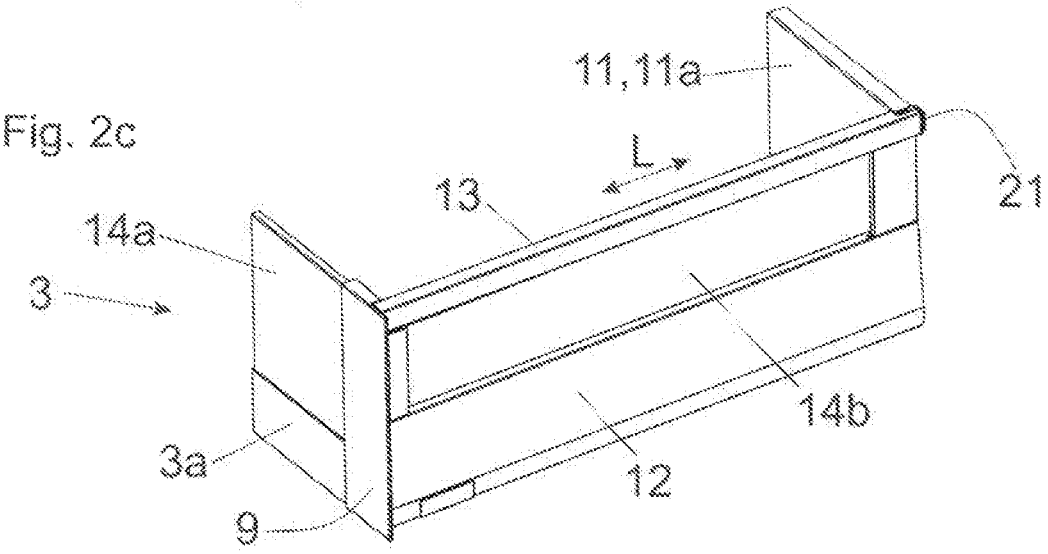

FIG. 2*a*-2*c* show the mounting operation of the railing strut 13 to the drawer 3 in temporal sequences. The drawer 3 includes a first wall element 9 and a second wall element 3*a* for receiving a first decorative plate 14*a*. The first decorative plate 14*a*, as with the second decorative plate 14*b*, can be formed of glass, stone, wood, plastic or metal. A furniture fitting 15 in the form of a connecting pin is formed or arranged on the first wall element 9, the furniture fitting 15 being configured to be connected to a first end region of the railing strut 13. In the shown embodiment, the first end region of the railing strut 13 includes a cavity 18 for receiving the furniture fitting 15. A recess 16 is arranged on the second end region of the railing strut 13, the recess 16 having substantially a rectangular shape or a L-shape in a top view and being provided for partially receiving the second wall element 11 in a mounted condition of the railing strut 13. The railing strut 13 is provided with a supporting portion 17 configured to be inserted into a, preferably horizontally extending, opening 19 of the second wall element 11. At least one movably mounted locking element 23*a* is arranged in the recess 16 of the railing strut 13, the locking element 23*a* being configured to be locked to a first recess 20 of the second wall element 11. By an actuating element 21, the locking between the railing strut 13 and the second wall element 11 can be released when the railing strut 13 is in a mounted condition. A notional connecting line 22 (see FIG. 2*b*) is arranged perpendicular to the first and second wall elements 9, 11.

For mounting the railing strut 13, the procedure will be as follows:

- a first end region of the railing strut 13 is connected to the first wall element 9 or to a furniture fitting 15 mounted to the first wall element 9 (FIG. 2*b*), and the railing strut 13 encloses an acute angle relative to the notional connecting line 22 arranged perpendicular to the wall elements 9, 11,
- the acute angle is decreased relative to the notional connecting line 22 by pivoting the railing strut 13 (FIG. 2*c*) (i.e., moving at least a second end region of the railing strut 13 in a direction transverse to the longitudinal direction of the railing strut 13), until the railing strut 13 is aligned substantially parallel to the notional connecting line 22, and it is preferably the supporting portion 17 of the railing strut 13 is introduced into the opening 19 of the second wall element 11,
- the railing strut 13 is subsequently tilted about an axis extending in the longitudinal direction (L) of the railing strut 13, until the at least one locking element 23*a* of the railing strut 13 is locked with the second wall element 11, and it is preferably the at least one locking element 23*a* engages into a first recess 20 of the second wall element 11.

Demounting of the railing strut 13 from the second wall element 11 is effected such that the actuating element 21 is moved into a release position by applying a force (for example by applying pressure to the actuating element 21 in the longitudinal direction (L) of the railing strut 13). In the release position, the locking between the railing strut 13 and the wall element 11 or the furniture fitting 15 mounted to the wall element 9 can be released.

Figure 3A:
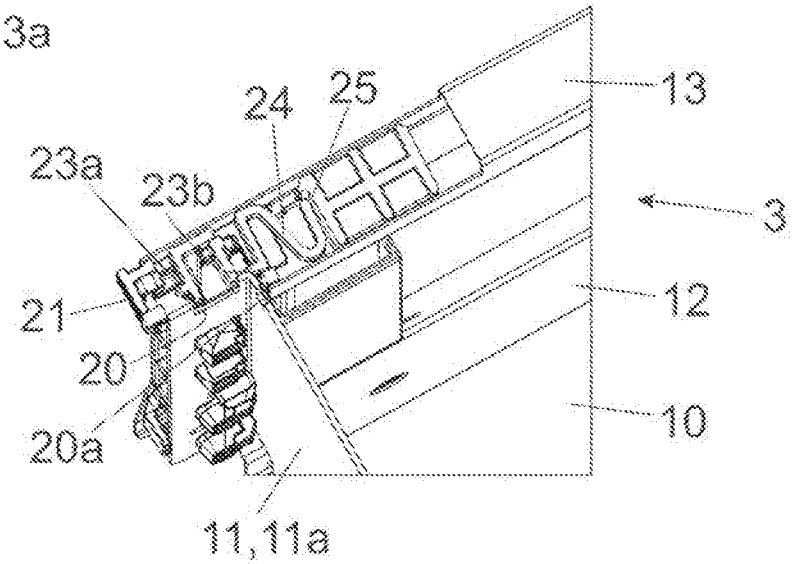
FIG. 3*a*-3*c* are partially broken-away perspective views of the rear end portion of the drawer, in which the locking and the unlocking of the railing strut is depicted.

FIG. 3*a* shows the rear end region of the drawer 3 in a perspective and partially broken-away view from above. In the shown embodiment, the railing strut 13 includes at least two movably mounted locking elements 23*a*, 23*b*. The first locking element 23*a* is configured to be releasably locked with the first recess 20 of the wall element 11, and the second locking element 23*b* is configured to be releasably locked with the second recess 20*a* of the wall element 11. The notional longitudinal axes of the recesses 20, 20*a* of the wall element 11 can thereby extend perpendicular to one another, whereby a very tilting-proof connection between the railing strut 13 and the wall element 11 can be enabled. The locking elements 23*a*, 23*b* are pre-stressed by at least one spring element 24, and the locking elements 23*a*, 23*b* can jointly be moved into the release position by applying a force to the actuating element 21 against a resilient action of the spring element 24. Here, the spring element 24 is formed by a resilient plastic portion which is supported on a stationary abutment portion 25 of the railing strut 13. For the spring element 24, mechanical spring elements can be implemented, for example compression springs, tension springs or torsional springs.

Figure 3B:
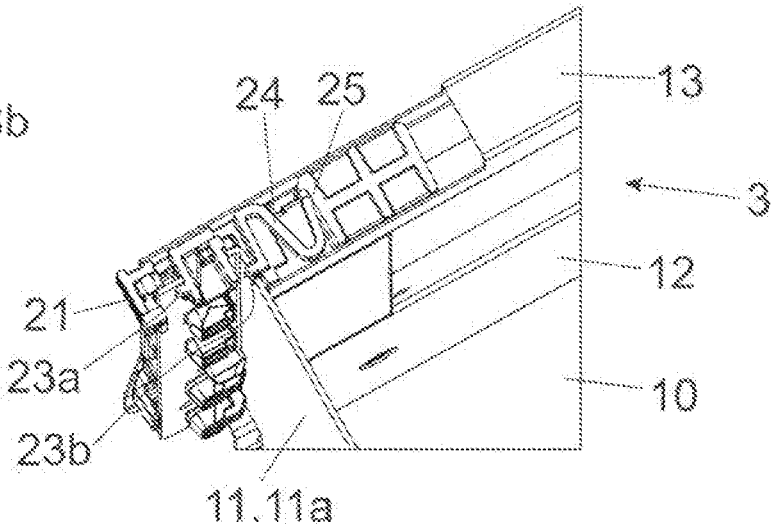
Figure 3C:
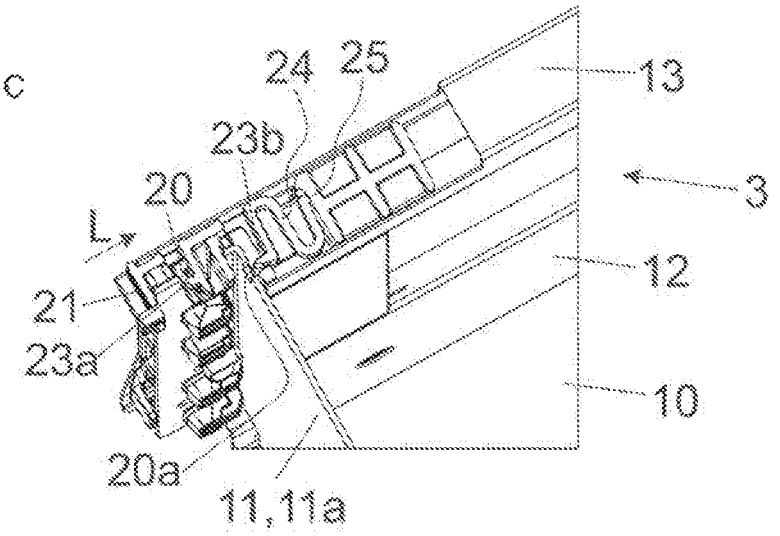

The railing strut 13 is pre-positioned on the wall element 11 such that the front-end portion of the railing strut 13 is slid onto the furniture fitting 15 and the supporting portion 17 of the rear-end portion is inserted into the opening 19 of the wall element 11. The pre-positioned state of the railing strut 13 is shown in FIG. 3*a*. By a subsequent manual tilting movement of the railing strut 13 about an axis extending in the longitudinal direction (L), the locking elements 23*a*, 23*b* are moved against a force of the spring element 24, whereupon the two locking elements 23*a*, 23*b* engage, preferably latch, into the recesses 20, 20*a* of the wall element 11 (FIG. 3*b*). In this way, the railing strut 13 is arranged without clearance in the longitudinal direction (L) relative to the drawer 3. Therefore, a very tilting-proof connection between the railing strut 13 and the wall element 11 can be established, because the railing strut 13, with the at least one end portion, is fixed to the wall element 11 on three positions deviating from one another (i.e. the supporting portion 17 in the opening 19, the first locking element 23*a* in first recess 20, and the second locking element 23*b* in the second recess 20*a* of the wall element 11). By applying a force to the actuating element 21 in the longitudinal direction (L), the locking between the locking elements 23*a*, 23*b* and the recesses 20, 20*a* of the wall element 11 can be again released (FIG. 3*c*), and the spring element 24 is maximally compressed in FIG. 3*c*. As shown in FIGS. 3*a*-3*c*, the spring element 24, the locking elements 23*a*, 23*b* and the actuating element 21 can have an integral one-piece construction.

Preferably, the first locking element 23*a* and/or the second locking element 23*b* can be moved in a longitudinal direction (L) of the railing strut 13 by applying a force to the actuating element 21.

Figure 4A:
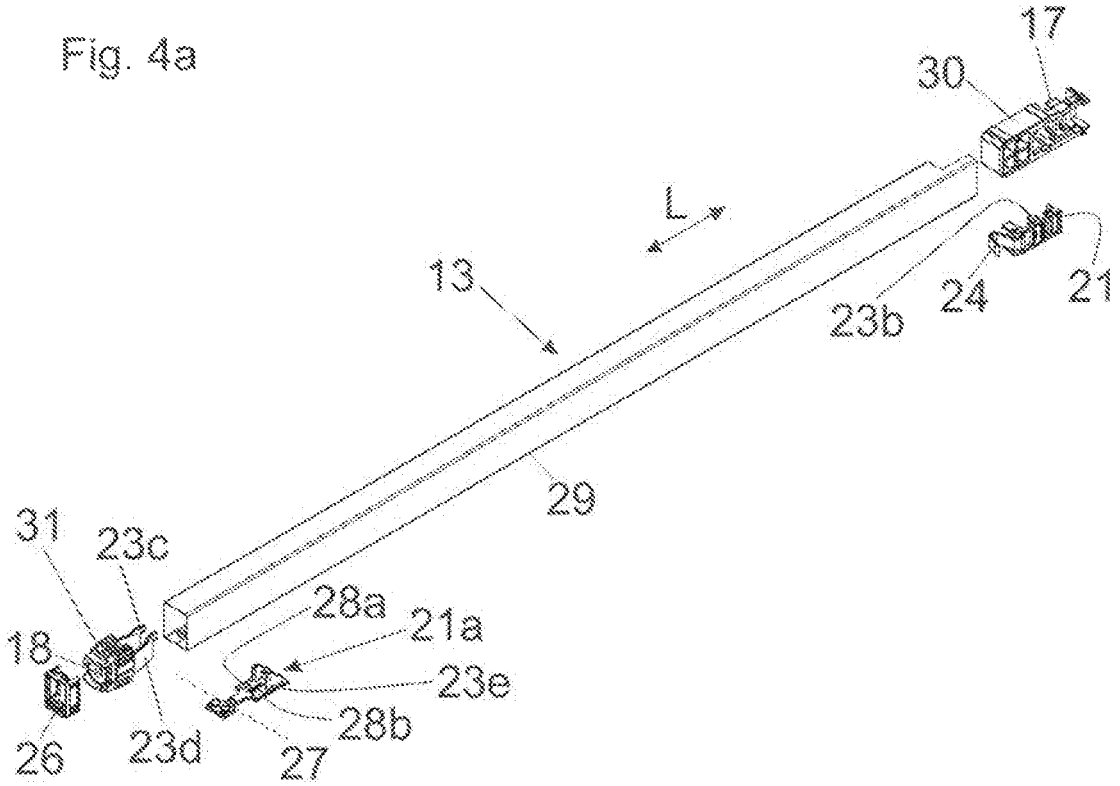
FIG. 4*a*, 4*b* show the railing strut in an exploded view and a cross-sectional view of the railing strut which is locked to a furniture fitting.

FIG. 4*a* shows the railing strut 13 in an exploded view, in which a movably mounted actuating element 21, 21*a* is provided on both end portions of the railing strut 13. The actuating elements 21, 21*a* are provided for releasing the locking between the front wall element 9 (for example with the furniture fitting 15 arranged on the wall element 9) and the rear wall element 11. The supporting portion 17 provided for pre-positioning the railing strut 13 is in the form of a tab arranged on a bearing portion 30, and the supporting portion 17 is configured to be introduced into the opening 19 of the wall element 11. The common constructional unit, consisting of the spring element 24, the locking elements 23*a*, 23*b* and the actuating element 21, is displaceably supported, in the mounted position, relative to the bearing portion 30 in the longitudinal direction (L) of the railing strut 13.

A length-compensating element 26 is arranged on the front-end portion of the railing strut 13. Preferably, the length-compensating element 26 is configured so as to be resilient in the longitudinal direction (L). The length-compensating element 26 serves for covering a gap formed between the front end of the railing strut 13 and the wall element 9, when the railing strut 13 is in a mounted condition with the wall elements 9, 11. The cavity 18 for receiving the furniture fitting 15 is formed in a receiving portion 31, and the furniture fitting 15 can be releasably locked by the movably-mounted locking elements 23*c*, 23*d* of the receiving portion 31. The head portion 33 (FIG. 4*b*) of the furniture fitting 15 is configured to be releasably locked with the locking elements 23*c*, 23*d* and by a locking element 23*e* connected to the second actuating element 21*a*. In the shown embodiment, the second actuating element 21*a* is arranged on a shell surface of the railing strut 13 (for example, on an underside 29 of the railing strut 13), and the second actuating element 21*a* is configured so as to be tiltable or bendable about a horizontally extending axis 27 in the mounted position. Inclined surface portions 28*a*, 28*b* are connected to the actuating element 21*a*, the inclined surface portions 28*a*, 28*b* being configured so as to elastically widen the locking elements 23*c*, 23*d* of the receiving portion 31 upon a movement of the second actuating element 21*a* about the axis 27, whereby the furniture fitting 15 (and therewith the wall element 9) can be released from the locking elements 23*c*, 23*d*, 23*e*.

Figure 4B:
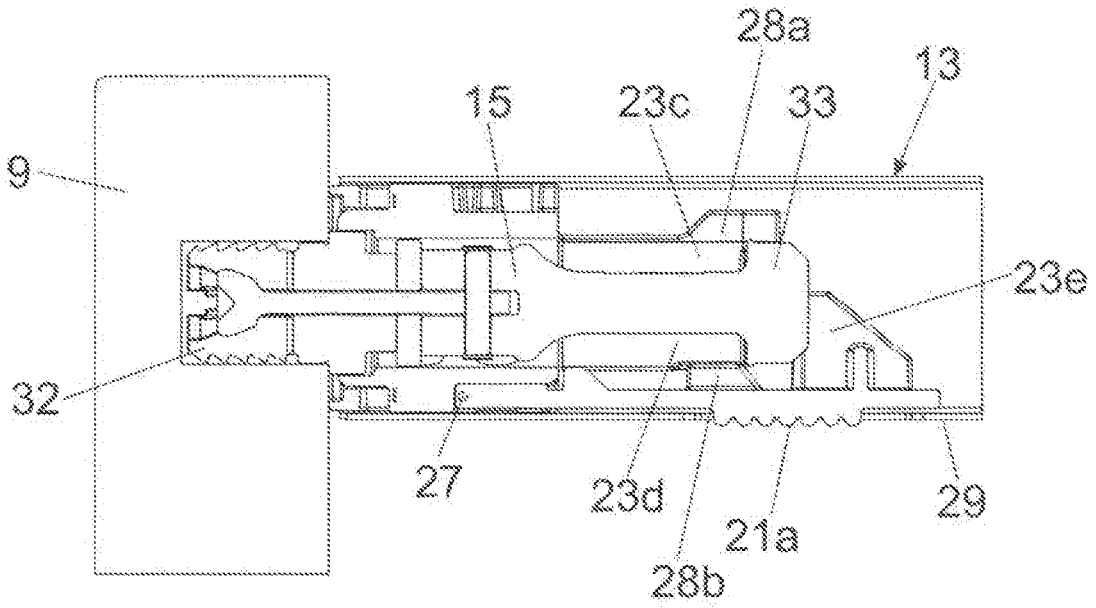

FIG. 4*b* shows a cross-sectional view of the front wall element 9, and the railing strut 13 is locked to the furniture fitting 15 arranged on the wall element 9. The furniture fitting 15 can include a dowel 32 for fixing to the wall element 9, and a head portion 33 spaced from the dowel 32. The head portion 33 is locked with the locking elements 23*c*, 23*d* of the receiving portion 31 and with the locking element 23*e* of the second actuating element 21*a*. The second actuating element 21*a* is arranged on the underside 29 of the railing strut 13 so as to be substantially flush with the underside 29 of the railing strut 13. The second actuating element 21*a*, as shown in FIG. 4*b*, can be provided with a ribbed surface or with a tool receiving device. The second actuating element 21*a* is configured to be bendable or tiltable about an axis 27 extending transversely to the longitudinal direction (L) by applying a force to the second actuating element 21*a*, so that the locking elements 23*c*, 23*d* can be widened by the inclined surface portions 28*a*, 28*b*. As a result, the head portion 33 of the furniture fitting 15 can be released. The regions of the head portion 33 and/or of the locking element 23*e* which come in contact with one another in a locked condition can include an inclined surface portion, whereby the head portion 33 can be actively ejected from the front cavity 18 of the railing strut 13 upon a movement of the second actuating element 21*a* about the axis 27. As a result, demounting of the railing strut 13 can be effected in a rapid and comfortable manner.

A particular advantage of the railing strut 13 lies in the fact that the railing strut 13, together with the locking device, forms a pre-assembled constructional unit and that-no additional functional elements (except for the opening 19 and the recesses 20, 20*a* of the wall element 11) for locking purposes must be provided on the drawer 3 to which the railing strut 13 is to be mounted. If appropriate, the railing strut 13 can also be configured to be adjustable in length. This can be made possible, for example, by at least two partial struts of the railing strut 13 configured to be telescopically displaceable relative to one another in the longitudinal direction (L).

The invention claimed is:

1. A railing strut for a drawer, comprising:

an end region configured to be connected to a wall element of the drawer;

a locking device on the end region, the locking device having at least two locking elements configured to be engaged with the wall element for locking the railing strut; and a movably mounted actuating element configured to move the at least two locking elements into a release position by applying a force to the actuating element, the release position being a position in which the locking between the railing strut and the wall element can be released when the railing strut is in a locked condition with the wall element, wherein the actuating element is accessible for manual actuation by an operator and can be directly actuated when the railing strut is locked to the wall element, so that the locking between the railing strut and the wall element can be released by the manual actuation of the actuating element, and wherein the at least two locking elements are configured to be jointly moved into the release position by applying a force to the actuating element, the at least two locking elements being spaced from one another along a longitudinal direction of the railing strut.

2. The railing strut according to claim 1, wherein the actuating element is displaceably arranged on the railing strut.

3. The railing strut according to claim 2, wherein the actuating element is configured to be displaceable on the railing strut along a longitudinal direction of the railing strut.

4. The railing strut according to claim 2, wherein the actuating element is configured to be tiltable or bendable about an axis extending horizontally in the mounted position.

5. The railing strut according to claim 1, wherein at least one of the at least two locking elements is configured to be moved in a longitudinal direction of the railing strut by applying a force to the actuating element.

6. The railing strut according to claim 1, wherein the at least two locking elements are pre-stressed by at least one spring element, the at least two locking elements being movable into the release position by applying a force to the actuating element against a force of the spring element.

7. The railing strut according to claim 6, wherein the at least one spring element is formed to have a one-piece construction with the at least two locking elements.

8. The railing strut according to claim 6, wherein the at least one spring element, the at least two locking elements and the actuating element together have a one-piece construction.

9. The railing strut according to claim 1, wherein the end region of the railing strut includes a supporting portion configured to be introduced into aa corresponding opening of the wall element or (ii) a corresponding opening of a furniture fitting fixed to the wall element for pre-positioning the railing strut on the wall element.

10. The railing strut according to claim 9, wherein the railing strut is configured to be manually tilted about an axis extending in the longitudinal direction of the railing strut from a position in which the supporting portion is introduced into the corresponding opening, whereby the at least two locking elements are locked to the wall element or to the furniture fitting fixed to the wall element.

11. The railing strut according to claim 1, wherein the end region is a first end region and the actuating element is a first actuating element, the railing strut having a second end region having a second movably-mounted actuating element for releasing the locking between the railing strut and the wall element or between the railing strut and a furniture fitting arranged or formed on the wall element.

12. An arrangement comprising:

the railing strut according to claim 1; and a wall element of a drawer, wherein the end region of the railing strut is configured to be releasably connected to the wall element by the locking device.

13. The arrangement according to claim 12, wherein the arrangement further comprises a drawer sidewall, and the railing strut is arranged above the drawer sidewall.

14. The arrangement according to claim 13, wherein the railing strut is arranged a predefined distance above the drawer sidewall.

15. A drawer comprising the arrangement according to claim 12.

16. A method for mounting a railing strut to a drawer, the drawer having at least two wall elements arranged substantially parallel to one another the railing strut including:

an end region configured to be connected to a wall element of the drawer;

a locking device on the end region, the locking device having a locking element configured to be engaged with the wall element for locking the railing strut; and a movably mounted actuating element configured to move the locking element into a release position by applying a force to the actuating element, the release position being a position in which the locking between the railing strut and the wall element can be released when the railing strut is in a locked condition with the wall element, wherein the actuating element is accessible for manual actuation by an operator and can be directly actuated when the railing strut is locked to the wall element, so that the locking between the railing strut and the wall element can be released by the manual actuation of the actuating element, the method comprising:

connecting a first end region of the railing strut to a first wall element of the at least two wall elements or to a furniture fitting mounted to the first wall element, wherein the railing strut encloses an acute angle relative to a notional connecting line arranged perpendicular to the at least two wall elements;

decreasing the acute angle relative to the notional connecting line by pivoting the railing strut; until the railing strut is aligned substantially parallel to the notional connecting line; and subsequently tilting the railing strut about an axis extending in the longitudinal direction of the railing strut; until the at least two locking elements of the railing strut are locked with the second wall element.

17. The method according to claim 16, further comprising moving the actuating element into a release position by applying a force, the release position being a position in which the locking between the railing strut and the wall element or the furniture fitting arranged or formed on the wall element is released.

18. The method for mounting the railing strut according to claim 16, wherein a supporting portion of the railing strut is introduced into an opening of the second wall element, and the at least two locking elements engage into a recess of the second wall element.

19. A railing strut for a drawer, comprising:

an end region configured to be connected to a wall element of the drawer;

a locking device on the end region, the locking device having a locking element configured to be engaged with the wall element for locking the railing strut;

a movably mounted actuating element configured to move the locking element into a release position by applying a force to the actuating element, the release position being a position in which the locking between the railing strut and the wall element can be released when the railing strut is in a locked condition with the wall element, wherein the actuating element is accessible for manual actuation by an operator and can be directly actuated when the railing strut is locked to the wall element, so that the locking between the railing strut and the wall element can be released by the manual actuation of the actuating element, wherein the end region of the railing strut includes a supporting portion configured to be introduced into (i) a corresponding opening of the wall element or (ii) a corresponding opening of the furniture fitting fixed to the wall element for pre-positioning the railing strut on the wall element, and wherein the railing strut is configured to be manually tilted about an axis extending in the longitudinal direction of the railing strut from a position in which the supporting portion is introduced into the corresponding opening, whereby the locking element is locked to the wall element or to the furniture fitting fixed to the wall element.

20. An arrangement comprising:

a wall element of a drawer; and a railing strut connected to the drawer, the railing strut including:

an end region to be connected to the wall element of the drawer;

a locking device on the end region, the locking device having a locking element to be engaged with the wall element for locking the railing strut to the wall element; and a movably mounted actuating element configured to move the locking element into a release position by applying a force to the actuating element, the release position being a position in which the locking between the railing strut and the wall element can be released when the railing strut is in a locked condition with the wall element, wherein the actuating element is accessible for manual actuation by an operator and can be directly actuated when the railing strut is locked to the wall element, so that the locking between the railing strut and the wall element can be released by the manual actuation of the actuating element, and wherein the railing strut is configured to be connected to the wall element by moving the railing strut in a direction transverse to the longitudinal direction of the railing strut.

* * * * *